US005129701A

United States Patent [19]

Pine

[11] Patent Number: 5,129,701

[45] Date of Patent: Jul. 14, 1992

[54] DOUBLE-SHIFT CARRIAGE MECHANISM FOR FULL RECLINE INCLINER CHAIR

[75] Inventor: James J. Pine, Tupelo, Miss.

[73] Assignee: Dbju, Inc., Verona, Miss.

[21] Appl. No.: 652,202

[22] Filed: Feb. 5, 1991

Related U.S. Application Data

[63] Continuation-in-part of Ser. No. 604,020, Oct. 26, 1990, abandoned.

[51] Int. Cl.[5] ..... A47C 1/02

[52] U.S. Cl. ..... 297/68; 297/84; 297/85; 297/88; 297/89

[58] Field of Search ..... 297/83-85, 297/88, 89, 68, DIG. 7

[56] References Cited

U.S. PATENT DOCUMENTS 4,202,580 5/1980 Johnson ..... 297/84
4,805,960 2/1989 Tacker ..... 297/85
4,895,411 1/1990 Pine ..... 297/88

*Primary Examiner*—Kenneth J. Dorner
*Assistant Examiner*—Milton Nelson, Jr.
*Attorney, Agent, or Firm*—Watson, Cole, Grindle & Watson

[57] ABSTRACT

A double-shift carriage mechanism for supporting the seat, backrest, footrest and legrest of a full recline incliner chair includes mirror image right and left support assemblies connected by a torque tube, each support assembly including an incline frame subassembly, an extendable footrest-legrest subassembly, a toggle drive subassembly, and a recline frame subassembly, the incline frame subassembly shifting from a retracted to an extended condition to convert the chair from an upright to an inclined state and the recline frame subassembly then shifting from a retracted to an extended condition, thus moving the incline frame subassembly along a substantially straight line and converting the chair from an inclined to fully reclined state.

11 Claims, 8 Drawing Sheets

DOUBLE-SHIFT CARRIAGE MECHANISM FOR FULL RECLINE INCLINER CHAIR

CROSS REFERENCE TO RELATED APPLICATION

The present application is a continuation-in-part of application Ser. No. 604,020, filed Oct. 26, 1990.

BACKGROUND OF THE INVENTION

1. Field of the Invention

The present invention relates to a full recline incliner chair, and more particularly to the carriage mechanism mounted therein which operates to support and move the seat, backrest, legrest and footrest when the full recline incliner chair is converted between its upright state, its inclined state and its full reclined state.

2. The Prior Art

Full recline incliner chairs are well-known in the furniture industry. The shift carriage mechanisms thereof which support the seat, backrest, legrest and footrest of the chairs when the chairs are converted between their upright, inclined and full reclined states make use of roller and guide track subassemblies, i.e., to enable the carriage mechanism to convert the chair between its inclined and full reclined states. Such roller and guide track subassemblies are disadvantageous, however, because of the jamming which can occur when a roller breaks or a staple used in construction of the chair becomes lodged in one of the guide track(s) thereof.

The object of the present invention is to provide a doubleshift carriage mechanism for a full recline incliner chair which does not require the use of roller and guide track subassemblies.

SUMMARY OF THE INVENTION

According to the present invention, the double-shift carriage mechanism for a full recline incliner chair utilizes interconnected left and right support assemblies which each include an incline frame subassembly and recline frame subassembly, the recline frame subassembly being mounted to the chair and supporting the incline frame subassembly via linkage assemblies which can move the incline frame subassembly along a substantially straight line as the double-shift carriage mechanism is caused to shift from an intermediate extended condition (inclined state of the chair) to a fully extended condition (reclined state of the chair) and vice versa. The linkage assemblies do not require the use of rollers and guide tracks to cause the incline frame subassembly to move along a substantially straight line.

A further understanding of the invention will be achieved by reference to the accompanying drawings, taken in conjunction with the following discussion.

DETAILED DESCRIPTION OF THE PREFERRED EMBODIMENT

Figure 1:
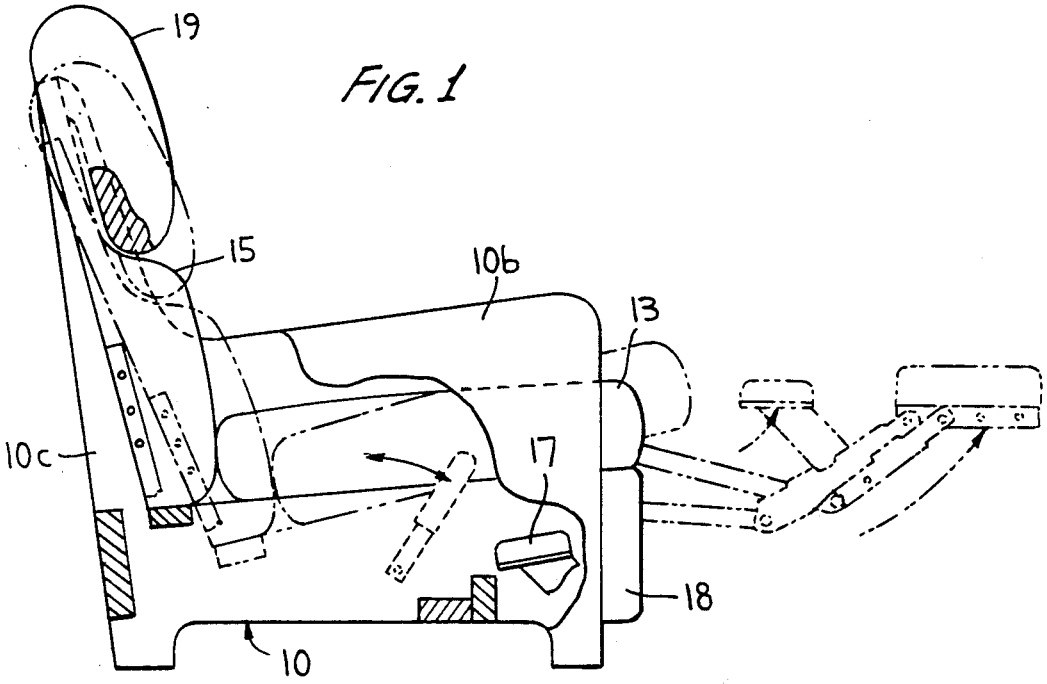
FIG. 1 is a schematic right side view of a full recline incliner chair which incorporates a double-shift carriage mechanism according to the present invention, the relative positioning of the seat, backrest, legrest and footrest of the chair when the double-shift carriage mechanism is in its retracted condition (upright state of the chair) being shown in solid lines and their relative positioning when the carriage mechanism has been shifted to its intermediate extended condition (inclined state of the chair) being shown in phantom.
Figure 2:
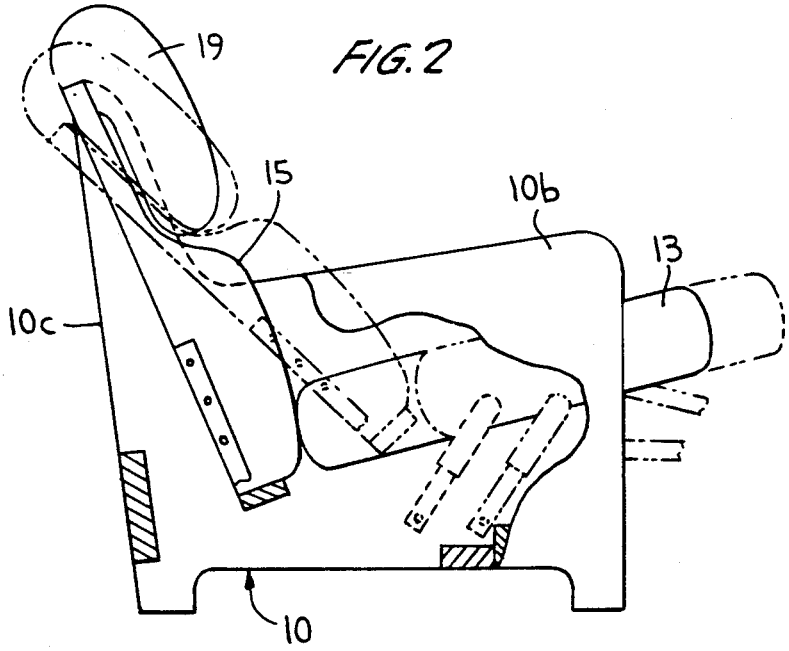
FIG. 2 is a schematic right side view of a portion of the full recline incliner chair of FIG. 1 showing in solid lines the seat and backrest when the chair is in its inclined state and in phantom the seat and backrest when the chair is in its full reclined state (which corresponds to the double-shift carriage mechanism therein being in its fully extended condition)

A full recline incliner chair which incorporates a double-shift carriage mechanism for supporting and moving the seat, backrest, legrest and footrest thereof according to the present invention is schematically shown in FIGS. 1 and 2. The chair comprises a frame 10 that includes left and right side members 10*a*, 10*b* (see FIG. 3) that provide support legs along their lower edges, and an upwardly-extending back member 10*c*. The frame 10 is intended to remain stationary on the surface on which it is positioned regardless of whether the chair is in its inclined or full reclined states. The full recline incliner chair also includes a seat 13, a backrest 15, a legrest 17, a footrest 18 and a headrest cushion 19. The seat, backrest, legrest and footrest are mounted on the double-shift carriage mechanism of the invention, which in turn is mounted on the left and right side members of the chair. When the double-shift carriage mechanism is in its retracted condition, which corresponds to the chair being in its upright state, the seat 13 will be generally horizontally oriented, the backrest 15 will be only slightly backwardly inclined, and both the legrest 17 and footrest 18 will be positioned beneath the seat 13 (see the solid line positions of these elements in FIG. 1). When the double-shift carriage mechanism is shifted to its intermediate extended condition, which corresponds to the chair being in its inclined state, the seat will be inclined upwardly, its front end being located forwardly and above its prior position, the backrest 15 will be lower and more inclined rearwardly, and both the legrest 17 and footrest 18 will be positioned in front of the seat (see the phantom line positions of these elements in FIG. 1). The relative positioning and orientation of the seat and backrest will remain the same. When the double-shift carriage mechanism is shifted to its fully extended condition, which corresponds to the chair being in its full reclined state, the seat 13 will be located forwardly and above its prior position (see solid and phantom line positions in FIG. 2), the backrest 15 will be maximally inclined rearwardly, and both the legrest 17 and footrest 18 will have moved forwardly and upwardly in unison with the seat 13. The relative positioning and orientation of the seat and backrest will change such that the angle therebetween will have increased, whereas the positioning and orientation of the legrest 17 and footrest 18 relative to the seat 13 will remain the same. The headrest cushion 19 is attached to the upper end of the backrest 15 and moves in unison therewith.

Figure 3:
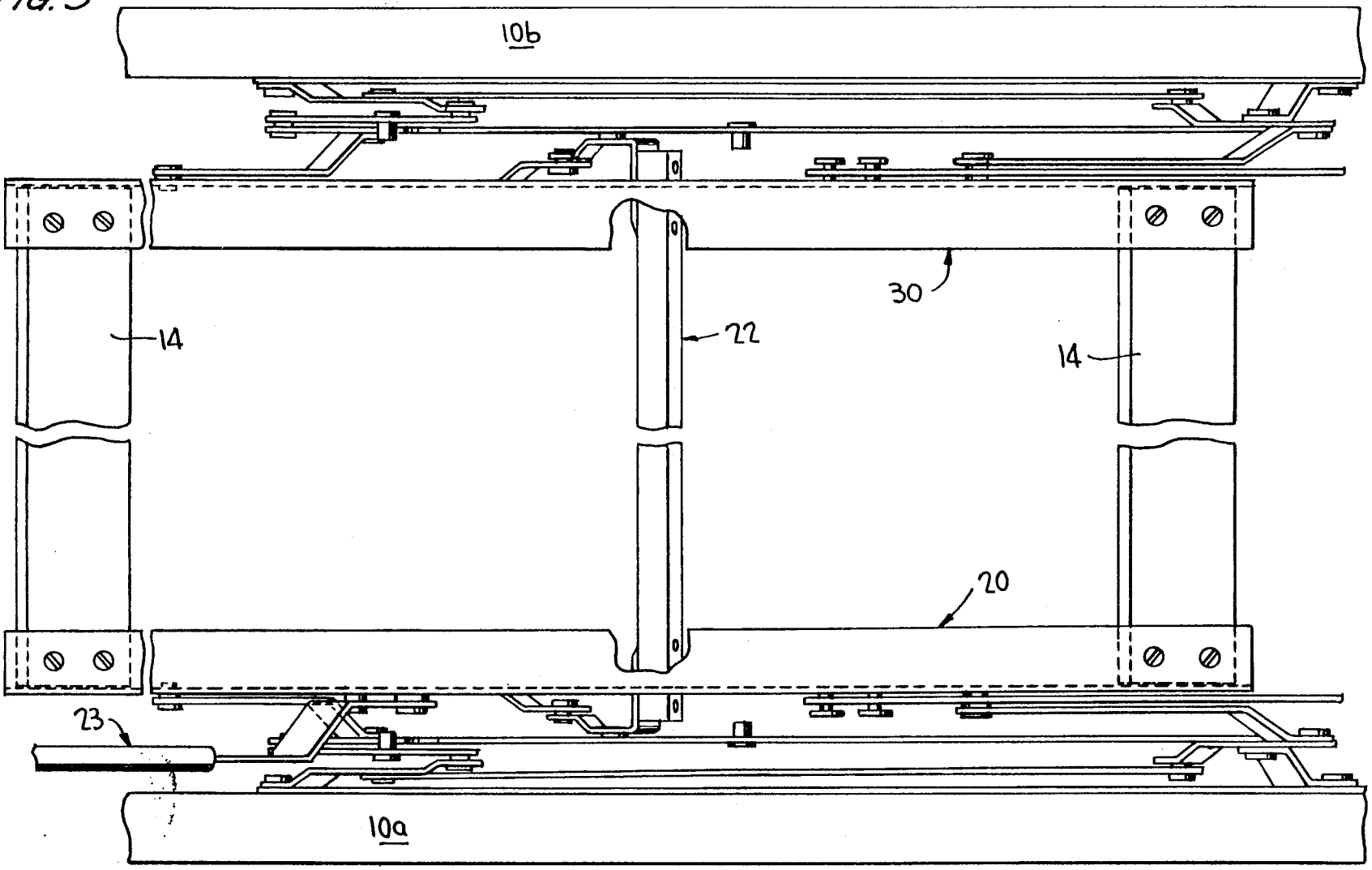
FIG. 3 is a partial top plan view of the double-shift carriage mechanism mounted within the full recline incliner chair of FIGS. 1 and 2 when the mechanism is in its intermediate extended condition, the chair being depicted in reverse orientation as compared to FIGS. 1 and 2, FIG. 4 and 4*a* show respective rear and front portions of the right support assembly of the double-shift carriage mechanism of FIG. 3, i.e., as seen from inside the chair, when the assembly is in its intermediate extended condition.

The double-shift carriage mechanism in the full recline incliner chair of FIGS. 1 and 2 is shown in detail in FIGS. 3–8. It includes a left support assembly 20, a right support assembly 30, a torque tube 22 which is interconnected between the left and right support assemblies, and an actuating mechanism 23 which is shown in FIG. 3 connected to the left support assembly. The left support assembly is constructed to be a mirror image of the right support assembly, such that a description of the right support assembly will suffice to describe the left support assembly. In the following description of the right support assembly 30 the terms outer and outwardly will relate to a relative location or side opposite (facing or extending away from) the left support assembly 20 and the terms inner and inwardly will relate to the location or side towards (facing or extending towards) the left support assembly 20, while the terms front and rear will relate to an orientation relative to the front and rear of the chair 10.

The right support assembly 30 includes an incline frame subassembly 40, a footrest-legrest subassembly 60, a toggle drive subassembly 80, and a recline frame subassembly 100.

Figure 6:
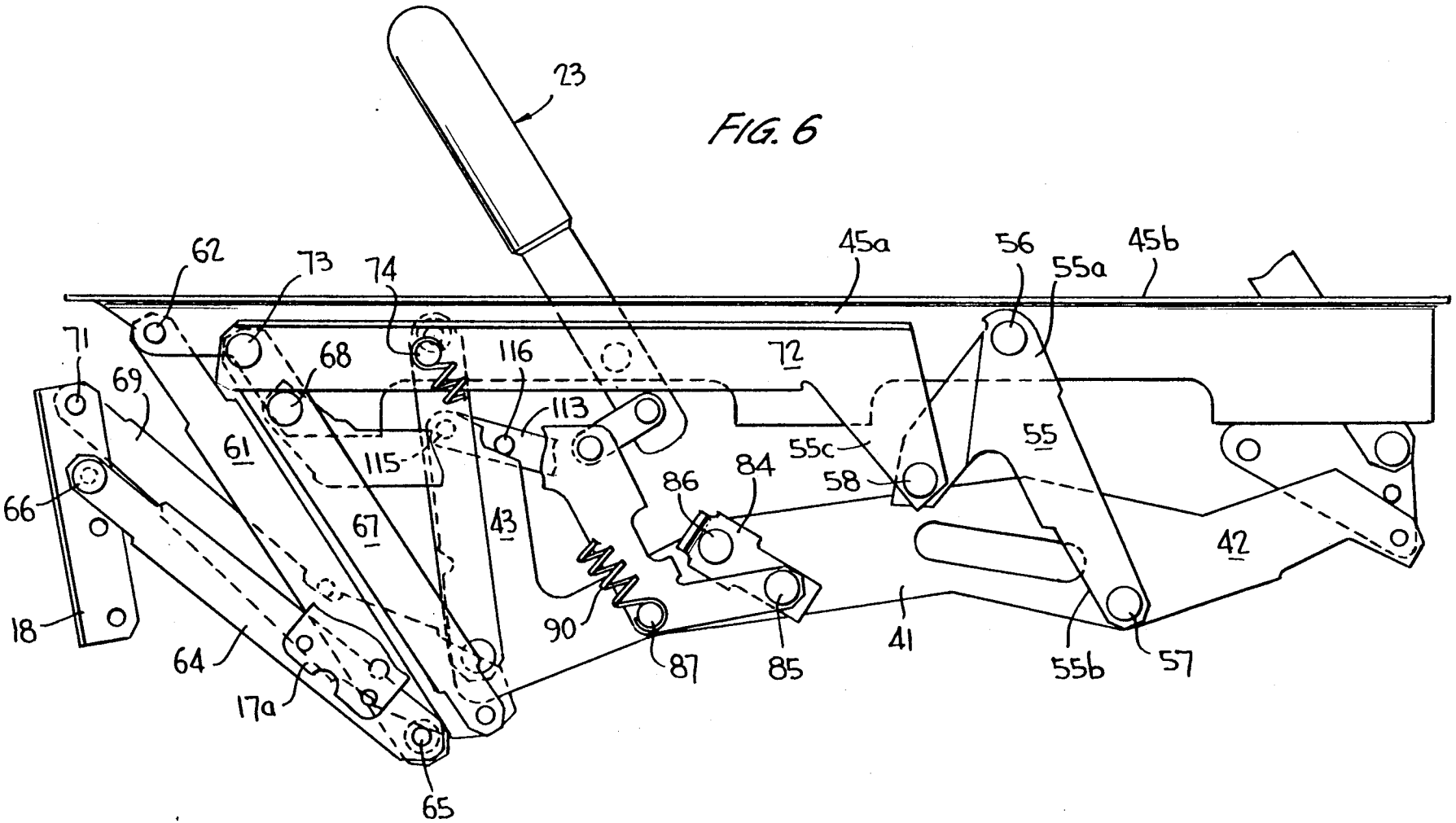
FIG. 6 shows the incline frame subassembly of the right support assembly when the assembly is in its retracted condition.
Figure 7:
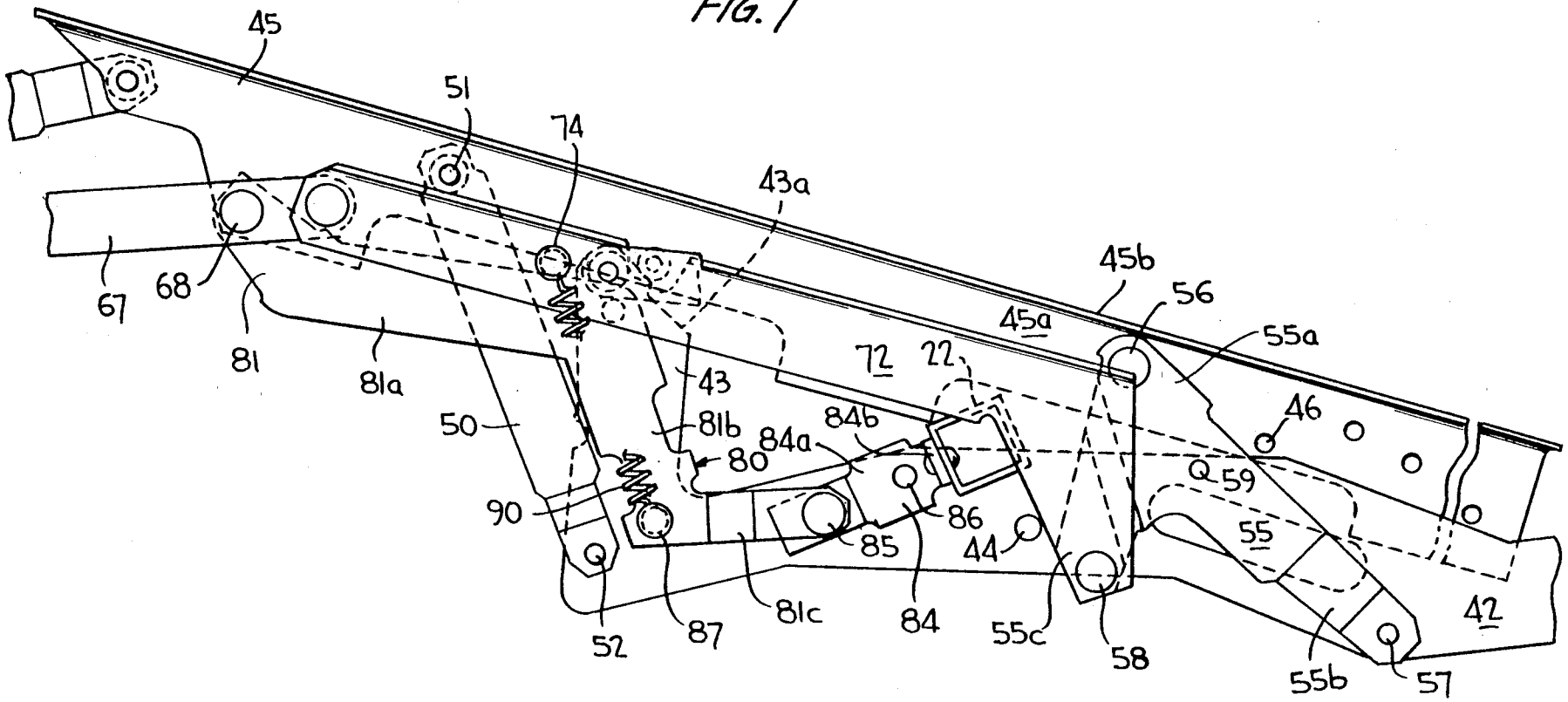
FIG. 7 shows the incline frame subassembly of the right support assembly when the assembly is in either its intermediate or fully extended condition.

The incline frame subassembly 40 includes an angular base member 41 which includes a longitudinal portion 42 and an upright portion 43 at the front end of the longitudinal portion. The angular base member is connected to the recline frame subassembly 100, which is positioned between the incline frame subassembly and the right side member 10*a* of the chair 10 (behind the incline frame subassembly as depicted in FIGS. 6 and 7), as will be discussed below. The incline frame subassembly also includes an elongated mounting rail 45 which is movably mounted above the base member 41 by front and rear strut members 50 and 55. The mounting rail 45 includes a vertical flange 45*a* and an inwardly-extending transverse flange 45*b*. The transverse flange 45*b* includes suitable holes near its front and rear ends (see FIG. 3) for attachment to the ends of front and rear cross beams 14 that support the seat 13. The vertical flange 45*a* includes a hole 46 at its rear end (see FIG. 7) for connection (by a pivot pin) of a backrest support flange.

The front strut member 50, which has a rectilinear configuration, has a top end which is located outwardly of the vertical flange 45*a* of the mounting rail 45 and is pivotally connected thereto by a pivot pin 51, while its lower end is located inwardly of the base member 41 and is pivotally connected thereto by a pivot pin 52. The rear strut member 55 is configured to have a head portion 55*a*, a first downwardly-extending leg portion 55*b* and a second downwardly-extending leg portion 55*c*. Its head portion 55*a* is located inwardly of the vertical flange 45*a* of the mounting rail 45 and is pivotally connected thereto by a pivot pin 56, while the lower end of its first leg portion is located inwardly of the base member 41 and is pivotally connected thereto by a pivot pin 57. The second leg portion 55*c*, which is shorter in length than the first leg portion and extends forwardly thereof, is connected by a pivot pin 58 to the rear end of a drive arm 72 of the footrest-legrest subassembly 60 (described below). The front and rear strut members are connected to the mounting rail such that, starting from a first positioning of the mounting rail above the base member (see FIG. 6) counterclockwise rotation of these strut members about the respective pivot pins 52 and 57 will cause the mounting rail to move forwardly relative to the base member 41 and simultaneously become more inclined, with its rear end moving downwardly towards the base member 41, until it reaches a second positioning relative to the base member, which is the positioning depicted in FIG. 7.

Figure 4:
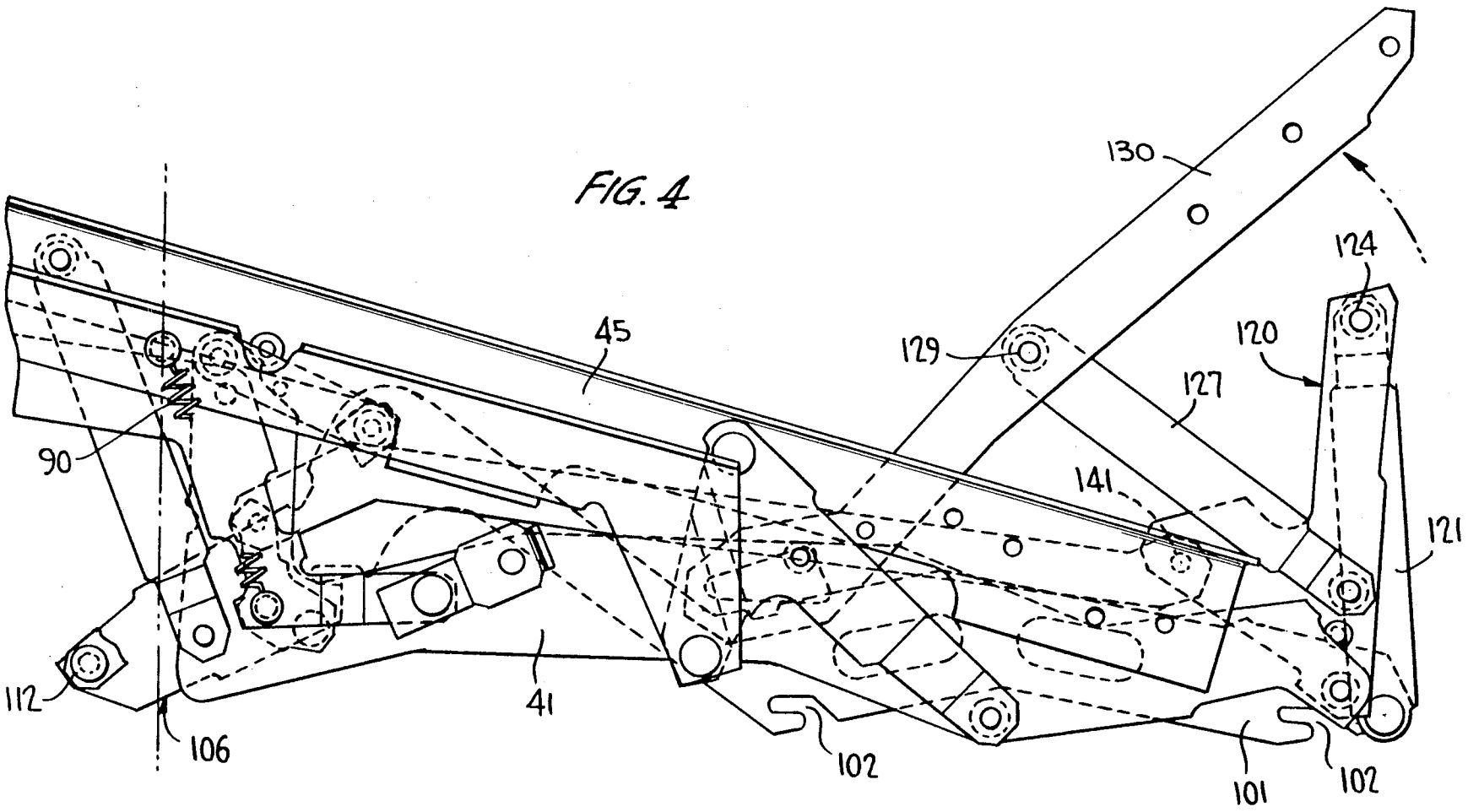
Figure 4A:
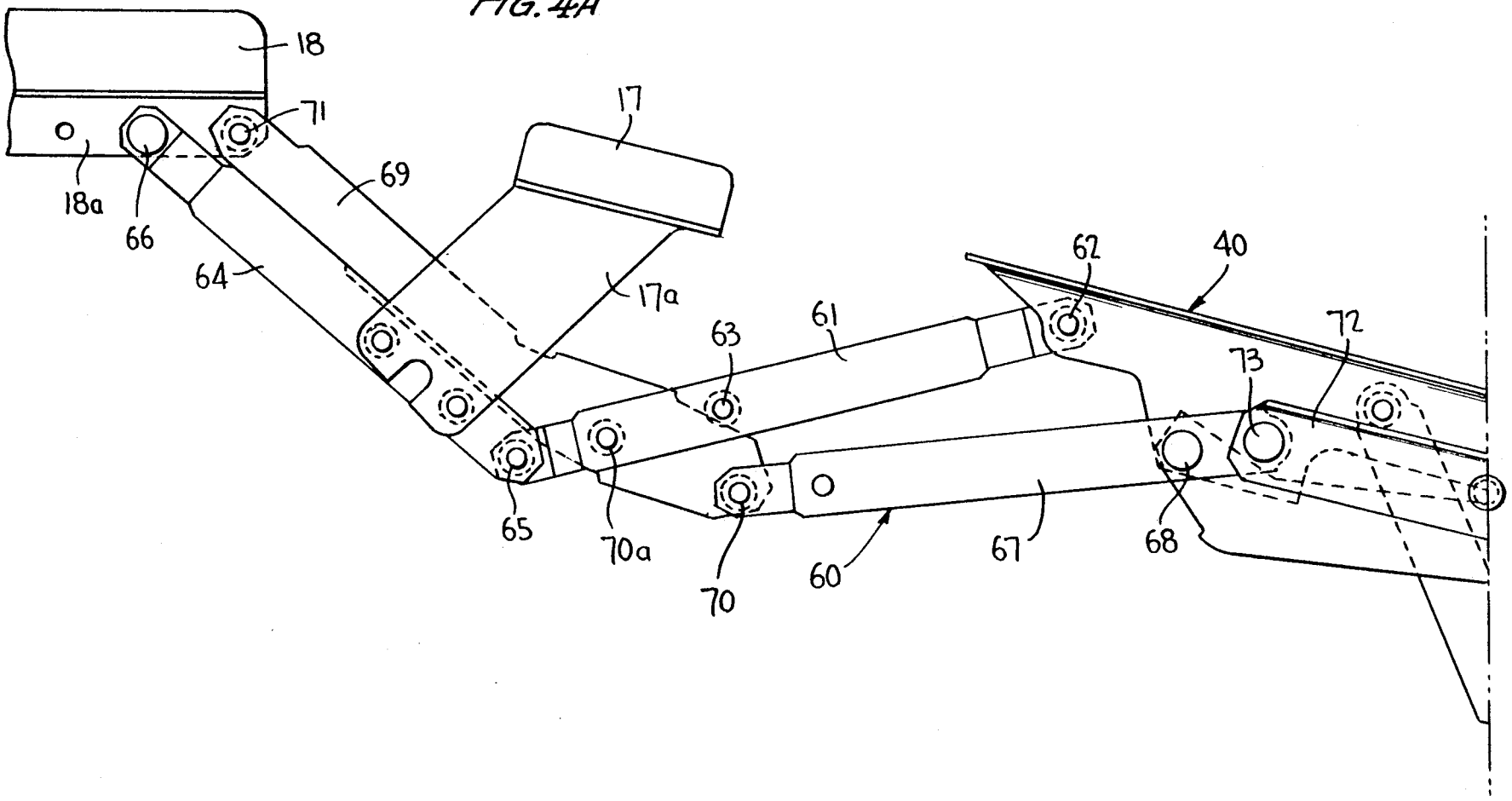

The footrest-legrest subassembly 60, which is of the pantograph or lazy-tong type, is identical to that shown in my aforementioned copending application, and includes a first link arm 61 (see FIG. 4*a*) which is pivotally attached at its upper end to the front end of the vertical flange 45*a* of the mounting rail 45 by a pivot pin 62, a second link arm 64 whose lower end is pivotally attached by a pivot pin 65 to the first link arm and at its upper end to the footrest bracket 18*a* by a pivot pin 66, a third link arm 67 which is pivotally attached near its upper end to the vertical flange 45*a* of the mounting rail 45 by a pivot pin 68 located rearwardly of and below the pivot pin 62, and a fourth link arm 69 whose lower end is pivotally attached by a pivot pin 70 to the lower end of the third link arm 67 and by a pivot pin 70*a* to the first link arm 61, and whose upper end is attached to the footrest bracket 18*a* by a pivot pin 71. Its pivotal movement relative to the first link arm when extended is limited by an upper edge thereof abutting against a stop pin 63 projecting from the first link arm. A generally L-shaped legrest platform 17*a* for the legrest 17 is attached to the second link arm 64 near its lower end. The drive arm 72 is positioned inwardly of the vertical flange 45*a* and beneath the transverse flange 45*b* of the mounting rail and is connected at its rear end to the pivot pin 58 and at its front end to the upper end of the third link arm 67 by a pivot pin 73.

The toggle drive subassembly 80, which is identical to the toggle drive subassembly disclosed in my aforemention copending application, is connected to the base member 41 of the frame subassembly 40, the mounting rail 45 of the frame subassembly 40 and to the drive arm 72 of the footrest-legrest subassembly 60. It comprises an upper toggle link 81, a lower toggle link 84 and a drive spring 90. The upper toggle link 81, as it extends from a forward end to a rearward end, is configured to have a first, generally horizontal leg portion 81*a* which is connected at its forward end to pivot pin 68 between vertical flange 45*a* of the mounting rail 45 and the third link arm 67, a second, downwardly inclined leg portion 81*b*, and a third, upwardly inclined leg portion 81*c*. The lower toggle link 84 includes a first leg 84*a* and a transverse second leg 84*b*. The first leg 84*a* is connected near its lower end to the rear end of the leg portion 81*c* of the upper toggle link by a pivot pin 85 and near its upper end to the base member 41 by a pivot pin 86. The transverse second leg extends inwardly of the upper end of the first leg and includes holes for attachment to the associated end of the torque tube 22. The drive spring 90 extends from a stud 87 which projects inwardly from the lower end of the second leg portion 81*b* to a stud 74 which projects inwardly from the drive arm 72 at a point towards the front end thereof. An abutment pin 44 extends inwardly from the base member 41 at a point rearwardly of the pivot pin 86 so as to contact an upper edge of the first leg 84*a* of the lower toggle link 84 and limit rotation (counterclockwise in FIG. 7) of the lower toggle link around the pivot pin 86, i.e., when the toggle drive subassembly is in its locked state (which corresponds to mounting rail 45 being in a first position relative to the base member 41 in the incline frame subassemblies of both the right and left support assemblies).

Figure 8:
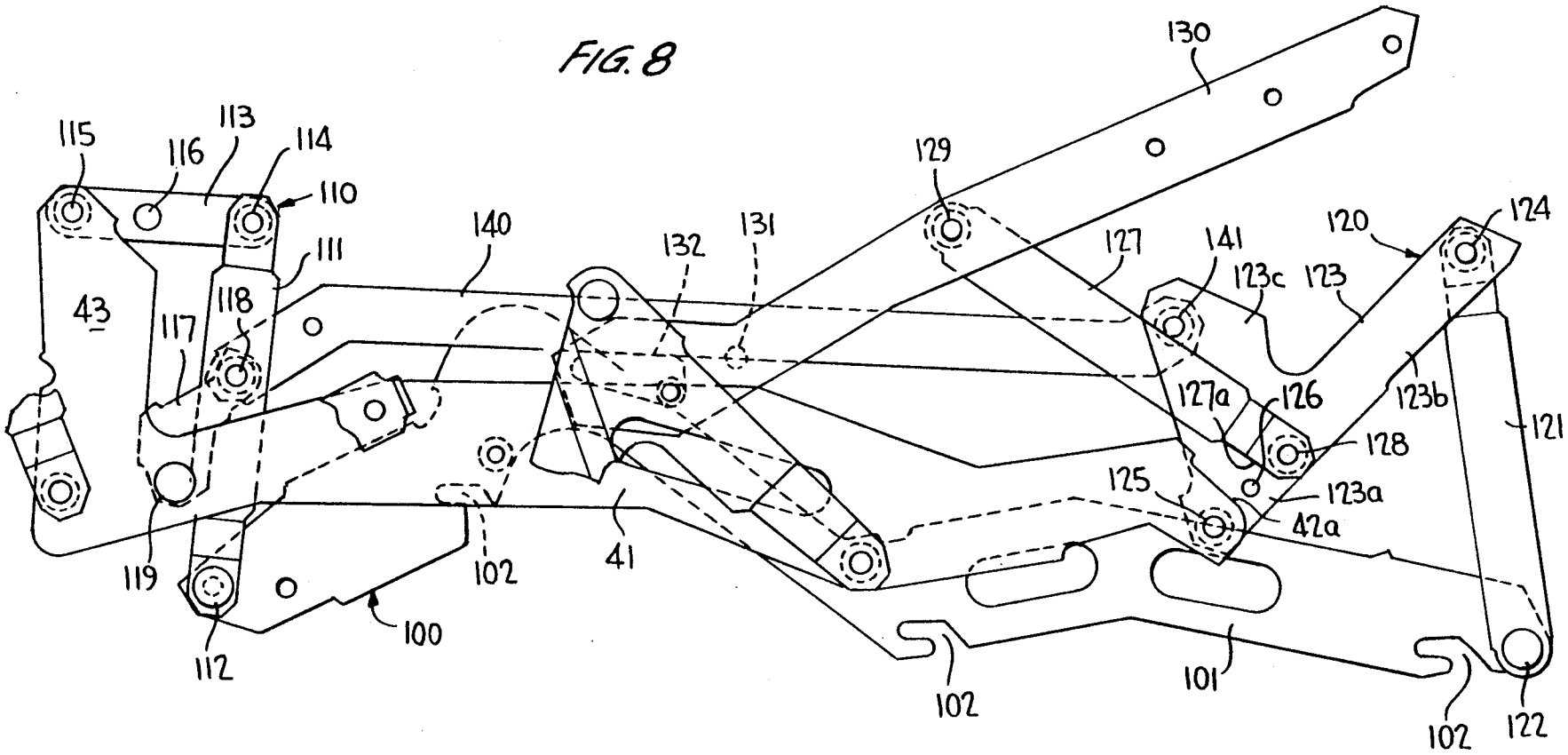
FIG. 8 shows the recline frame subassembly of the right support assembly and the base member of the incline frame subassembly when the recline frame subassembly is almost in its fully extended condition.

As best seen in FIG. 8, the recline frame subassembly 100 includes an angular mounting flange 101 which has three slots 102 along its length to enable it to be fixedly attached by suitable screws or bolts to the right side member 10*b* of the full recline incliner chair, a front linkage 110, a rear linkage 120, a backrest support flange 130 and a connection bar 140.

The front linkage assembly 110 includes recline link member 111, a top idler link member 113 and a bottom idler link member 117. The recline link member 111, which is elongated in configuration, is positioned inwardly of the mounting flange 101 and is pivotally attached at its lower end to the front end of the mounting flange 101 by a pivot pin 112. The top idler link member 113, which is elongated in configuration, is pivotally connected at its rear end to the upper end of the recline link member by a pivot pin 114 and at its forward end to the upper end of the portion 43 of the base member 40 by a pivot pin 115. The bottom idler link member 117, which has a curved configuration, is pivotally connected at one end to the recline link member 111 by a pivot pin 118 and at its second end to the base member 41 by a pivot pin 119.

The rear linkage assembly 120 includes a connecting link member 121, a bellcrank link member 123 and a rotation member 127. The connecting link member 121, which is elongated in configuration, is positioned inwardly of mounting flange 101 and is pivotally attached at its lower end to the rear end of the mounting flange 101 by a pivot pin 122. The bellcrank link member 123, which has a head portion 123*a*, a rear leg portion 123*b* and a front leg portion 123*c*, has its rear leg portion 123*b* pivotally attached to the upper end of the connecting link member by a pivot pin 124 and its head portion 123*c* pivotally attached to rear end of the base member 41 by a pivot pin 125. The rotation link member 127, which is elongated in configuration, is pivotally connected at its rear end to the bellcrank link member by a pivot pin 128, which is located above the pivot pin 125, and at its front end to a backrest support flange 130 by a pivot pin 129.

The backrest support flange 130 is positioned outwardly of the mounting rail 45 and is pivotally connected to vertical flange 45*a* thereof by a pivot pin 131. It includes a triangular cut out 132 at its lower end within which a sequencing pin 59 that extends outwardly from the rear strut member 55 can move. The connection bar 140 is pivotally connected at its rear end to the front leg 123*c* of the bellcrank link member by a pivot pin 141 and at its front end to the pivot pin 118.

Figure 5:
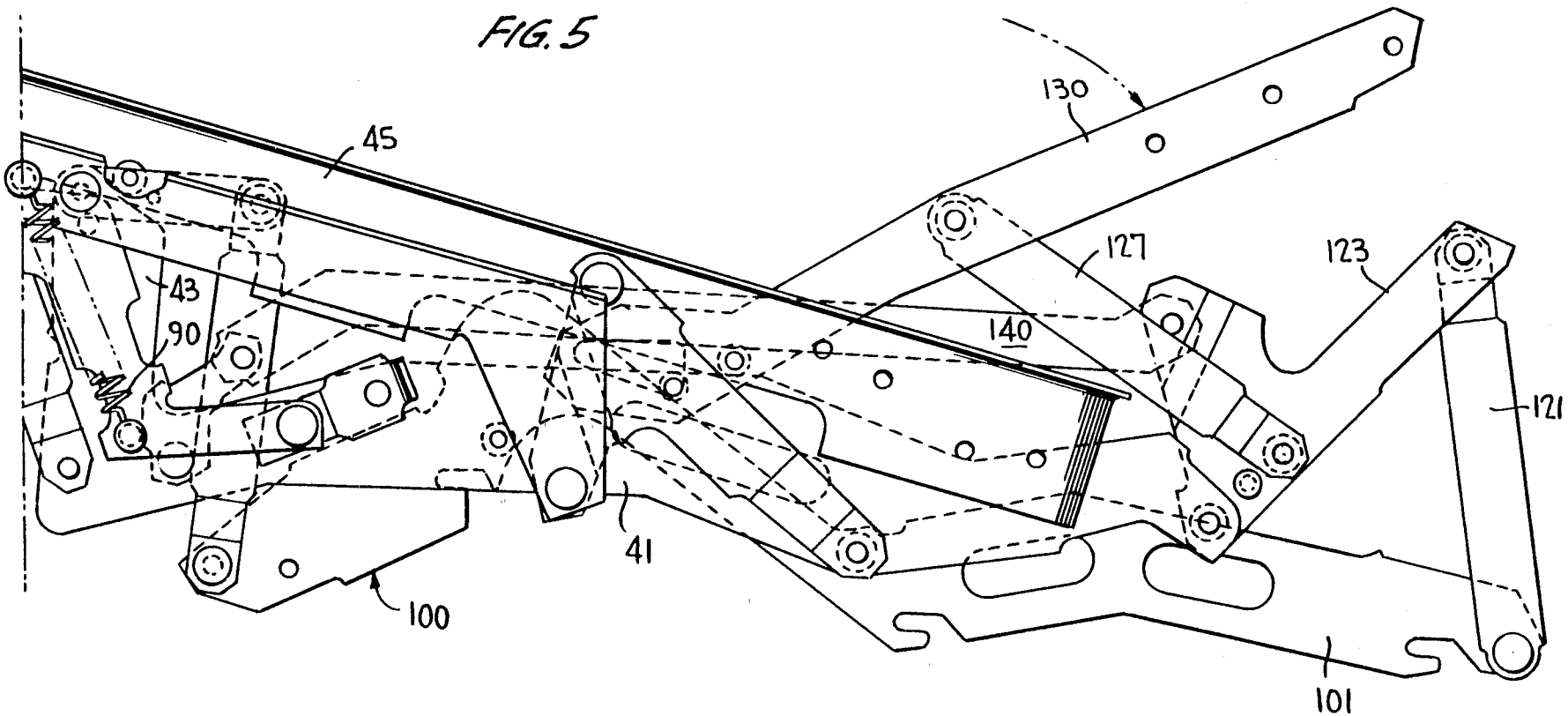
FIG. 5 shows the rear portion of the right support assembly as shown in FIG. 4 when the assembly is almost in its fully extended condition.

A stop pin 116 extending inwardly from the top idler link member 113 abuts a ledge 43*a* on the upright portion 43 of the base member 41 when the recline frame subassembly is either retracted, i.e., so as to position the base member 41 of the incline frame subassembly at a first positioning relative to the mounting plate 101 (FIG. 4), or extended, i.e., so as to position the base member 41 at a second positioning relative to the mounting 101 plate (almost reached in FIGS. 5 and 8). A similar function is achieved with a stop pin 126 which extends inwardly from the bellcrank link member 123 between pins 125 and 128 to abut either an edge 42*a* at the rear end of the longitudinal portion 42 of the base member 41 or a lower edge 127*a* of the rotation link member 127.

The actuator mechanism 23, which is connected to the incline frame subassembly of the left support assembly 20, is identically constructed to that disclosed in my aforementioned copending application.

When the right support assembly 30 is in its retracted condition, the left support assembly 20 will also be in its retracted condition, and the double-shift carriage mechanism as a whole will be in its retracted condition. This condition corresponds to the full recline incliner chair being in its upright state. The elements of the incliner frame subassembly 40, the footrest-legrest subassembly 60 and the toggle drive subassembly 80 of the right support assembly will be positioned and oriented relative to one another as indicated in FIG. 3 of my aforementioned copending application (the elements of the corresponding subassemblies of the incliner frame subassembly of the left support assembly 20 will be similarly positioned and oriented), and the elements of the recliner frame subassembly 100 will be in their retracted state (see FIG. 4).

With a manual rearward pull on the grip lever of the actuating mechanism 23, the upper toggle link of the incline frame subassembly of the left support assembly will move as disclosed in my copending application, the associated footrestlegrest assembly will to begin extend, the lower toggle link will rotate around its pivot pin, the toggle drive subassembly will become unlocked and will assist movement of the associated mounting rail from its first positioning relative to the associated base member to its second positioning. Due to torque tube 22, a similar rotation of lower toggle link 84 around pivot pin 86 will occur, causing the mounting rail 45 to be repositioned to its second positioning relative to the base member 41. The support assemblies will then be in their intermediate extended conditions (inclined state of the chair). It should be noted that during this movement the base members of the incline frame subassemblies will not move relative to the mounting plates of the recline frame subassemblies.

With a rearward movement against the backrest support flanges 130, the first and second linkages 110 and 120 will articulate, causing the base member of the attached inclined frame subassemblies to move to their second positionings relative to the elongated mounting flanges 101. The support subassemblies will then be in their fully extended conditions (reclined state of the chair). Downward and rearward pressure on the footrest 18 will cause the support subassemblies (and thus also the double-shift carriage mechanism) to return to their retracted conditions (upright state of the chair).

It should be noted that the sequencing pin 59 cooperates with the triangular cut out 132 in the backrest support flange 130 to prevent movement of the base member 41 of the incline frame subassembly from its first positioning to its second positioning relative to the mounting plate 101 if the mounting rail 45 is still in its first positioning relative to the base member 41. The triangular cut out nevertheless allows the sequencing pin to move freely relative to the backrest support flange during all shifting of the support assembly.

It should also be recognized that it is the front linkage 110 which is responsible for moving the incline frame subassembly along a straight line during shifting of the support subassembly from an intermediate extended condition to a fully extended condition.

Although a preferred embodiment of the invention has been shown and described, modifications can be made therein and still fall within the scope of the appended claims. For example, in a modified type of chair the footrest-legrest subassembly could be eliminated, the stud 74 could extend inwardly from the vertical flange 45*a*, and the sequencing pin 59 and the triangular cut out 132 in the backrest support flange could be eliminated.

What I claim is:

1. A support assembly for use in a double-shift carriage mechanism employed to support a seat, backrest, footrest and legrest of a full recline incliner chair, said support assembly being shiftable between a retracted condition, an intermediate extended condition and a fully extended condition, and comprising:

an incline frame subassembly which includes an elongated base member, an elongated mounting rail for supporting the seat and backrest of the chair, and front and rear strut members which pivotally mount the mounting rail above the base member so as to be in either a first positioning above the base member or a second positioning above the base member, said second positioning being forward and upwardly inclined relative to said first positioning, an extendable footrest-legrest subassembly connected to said incline from subassembly for supporting the footrest and legrest of the chair, said footrest-legrest subassembly being retracted when said mounting rail is in said first positioning above the base member and extended forwardly of said incline frame subassembly when said mounting rail is in said second positioning above the base member, a toggle drive subassembly which is connected between said mounting rail and said base member of said incline frame subassembly, said toggle drive subassembly being in either a locked state or an unlocked state, said mounting rail being in said first positioning above said base member when said toggle drive subassembly is in said locked state and in said second positioning above said base member when said toggle drive subassembly is in said unlocked state, and a recline frame subassembly which includes an elongated mounting plate that can be fixedly attached to the chair, front and rear linkages pivotally connected to said mounting plate, a backrest support flange pivotally connected to said mounting rail of said incline frame subassembly, and a connecting bar extending between said front and rear linkages, said front and rear linkages being connected to said base member of said incline frame subassembly and said backrest support flange, said front and rear linkages moving said base member between a first positioning relative to said mounting plate and a second positioning relative to said mounting plate, said second positioning being forward of said first positioning, said support assembly being in said retracted condition when said mounting rail is in said first positioning above said base member and said base member is in said first positioning relative to said mounting plate, the unlocking of said toggle drive subassembly causing said mounting rail of said incline frame subassembly to move from said first positioning above said base member to said second positioning, thus causing said support assembly to shift from its retracted condition to its intermediate extended condition, said base member remaining in said first positioning relative to said mounting plate, subsequent backward movement against said backrest support flange causing said first and second linkages to move said base member from said first positioning relative to said mounting plate to said second positioning, thus moving said incline frame subassembly forward relative to said mounting plate and causing said support assembly to shift from said intermediate extended condition to said fully extend condition, said mounting rail remaining in its second positioning above said base member, said incline frame subassembly being moved along a substantially straight line.

2. A support assembly according to claim 1, wherein said base member of said incline frame subassembly comprises a longitudinal portion having a front end and a rear end, and an upstanding portion at said front end.

3. A support assembly according to claim 2, wherein said mounting plate of said recline frame subassembly has a front end and a rear end, and wherein said front linkage of said recline frame subassembly is connected between said front end of said mounting plate and said upstanding portion of said base member.

4. A support assembly according to claim 3, wherein said front linkage comprises a first link having an upper end and a lower end, said lower end being pivotally connected to said front end of said mounting plate; a second link which is pivotally connected between an upper end of said first link and said upstanding portion of said base member; and a third link pivotally connected between said first link and said front end of said longitudinal portion of said base member.

5. A support assembly according to claim 4, wherein said first and second links are elongated in configuration and said third link is curved in configuration.

6. A support assembly according to claim 5, wherein said rear linkage of said recline frame subassembly is connected between said rear end of said mounting plate and said rear end of said longitudinal portion of said base member.

7. A support assembly according to claim 6, wherein said rear linkage comprises a fourth link having an upper end and a lower end, said fourth link being pivotally connected at said lower end to said rear end of said mounting plate; a fifth link which is pivotally connected to said upper end of said fourth link and to said rear end of said longitudinal portion of said base member, and a sixth link pivotally connected between said fifth link and said backrest support flange.

8. A support assembly according to claim 7, wherein said fourth and sixth links are elongated in configuration and said fifth link has a head portion and first and second portions, said fourth link being pivotally connected to said first leg portion, said rear end of said longitudinal portion of said base member being pivotally connected to said head portion and said sixth link being pivotally connected to said head portion.

9. A support assembly according to claim 8, wherein said connecting bar is pivotally connected between said first link and said second leg of said fifth link.

10. A double-shift carriage mechanism for movably supporting a seat, backrest, footrest and legrest of a full recline incliner chair, said double-shift carriage mechanism being shiftable between a retracted condition which corresponds to the chair being in an upright state, an intermediate extended condition which corresponds to the chair being in an inclined state, and a fully extended condition which corresponds to the chair being in a reclined state, said double-shift carriage mechanism comprising:

mirror image right and left support assemblies which each include (1) a incline frame subassembly which includes an elongated base member, an elongated mounting rail for supporting the seat and backrest of the chair, and front and rear strut members which pivotally mount the mounting rail above the base member so as to be in either a first positioning above the base member or a second positioning above the base member, said second positioning being forward and upwardly inclined relative to said first positioning, (2) an extendible footrestlegrest subassembly connected to said incline frame subassembly for supporting the footrest and legrest of the chair, said footrest-legrest subassembly being retracted when said mounting rail is in said first positioning above the base member and extended forwardly of said incline frame subassembly when said mounting rail is in said second positioning above the base member, (3) a toggle drive subassembly which is connected between said mounting rail and said base member of said incline frame subassembly, said toggle drive subassembly being in either a locked state or an unlocked state, said mounting rail being in said first positioning above said base member when said toggle drive subassembly is in said locked state and in said second positioning above said base member when said toggle drive subassembly is in said unlocked state, (4) a recline frame subassembly which includes an elongated mounting plate that can be fixedly attached to the chair, front and rear linkages pivotally connected to said mounting plate, a backrest support flange pivotally connected to said mounting rail of said incline frame subassembly, and a connecting bar extending between said front and rear linkages, said front and rear linkages being connected to said base member of said incline frame subassembly and said backrest support flange, said front and rear linkages moving said base member between a first positioning relative to said mounting plate and a second positioning relative to said mounting plate, said second positioning being forward of said first positioning, a torque tube connected between the toggle drive subassemblies of the incline from subassemblies of said right and left support assemblies, and an actuating mechanism which is manually operable to cause the toggle drive subassemblies of said incliner frame subassemblies of said left and right support assemblies to become unlocked.

11. A full recline incliner chair which includes a double-shift carriage mechanism as defined in claim 10.

* * * * *